US006021726A

United States Patent [19]

Muraki

[11] Patent Number: 6,021,726

[45] Date of Patent: Feb. 8, 2000

[54] REVERSIBLE PATCHWORK QUILT

[76] Inventor: Sachiyo Muraki, 516, 26-1 Tokiwadaira 1-chome, Matsudo-shi, Japan

[21] Appl. No.: 09/005,376

[22] Filed: Jan. 9, 1998

[30] Foreign Application Priority Data

Apr. 4, 1997 [JP] Japan ..... P.9-086228

[51] Int. Cl.[7] ..... D05B 11/00

[52] U.S. Cl. ..... 112/117; 112/441

[58] Field of Search ..... 112/439, 440, 112/441, 475.01, 475.06, 475.08, 475.18, 117

[56] References Cited

U.S. PATENT DOCUMENTS

| | | | |
|---|---|---|---|
| 4,395,964 | 8/1983 | Warren | 112/441 X |
| 4,646,666 | 3/1987 | Burrier | 112/441 X |
| 4,814,218 | 3/1989 | Shane | 112/439 X |
| 5,099,773 | 3/1992 | Codos | 112/439 X |
| 5,272,995 | 12/1993 | Harger | 112/440 X |
| 5,531,176 | 7/1996 | Johnson | 112/439 X |

FOREIGN PATENT DOCUMENTS

| | | |
|---|---|---|
| 5739990 | 8/1955 | Japan . |
| 57178524 | 5/1956 | Japan . |

*Primary Examiner*—Ismael Izaguirre
*Attorney, Agent, or Firm*—Jordan and Hamburg LLP

[57] ABSTRACT

A reversible patchwork having patterns in the surface and the reverse thereof. It is constructed by continuously stitching together units of motif M. Each of the units of motif M is constructed so that a circular or polygonal foundation cloth 1 is folded to the surface of the unit of motif M and encloses a domett core 3 therein and is stitched to an upper cloth 2. One of the foundation cloth 1 and the upper cloth 2 or both of them consist of different patterned cuttings for making diverse designs of the unit of motif M.

18 Claims, 11 Drawing Sheets

REVERSIBLE PATCHWORK QUILT

BACKGROUND OF THE INVENTION

1. Field of the Invention

The present invention relates to:

a reversible patchwork quilt which is constructed by cutting some a circle or a polygon to make a foundation cloth and an upper cloth, and stitching them together enclosing a domett core therein to make a unit of motif, and piecing the units continuously.

2. Prior Art

Conventionally, the techniques regarding a reversible patchwork quilt are disclosed in Japanese Utility Model Gazette No. 57-178524 or Japanese Utility Model Gazette No. 57-39990 by the same applicant.

The prior techniques are similar to the present invention in the respect of piecing the units of motif continuously to construct a reversible patchwork quilt. However, it is hard to diversify the design of the unit of motif because a foundation cloth and an upper cloth consist of a piece of cutting, whereby it is hard to bring out a complex image from a completed reversible patchwork quilt.

SUMMARY OF THE INVENTION

In the present invention, a foundation cloth and an upper cloth that compose a unit of motif consist of various cuttings to give various images on the unit of motif composing a reversible patchwork quilt.

Therefore, at first, there is no end to the ways to cut a foundation cloth and an upper cloth and there is no end to the type of to motif for each cloth, so that various designs and images can be constructed and a more complex patterned reversible patchwork quilt can be constructed.

Second when a unit of motif is constructed, the number of patterns of the seam increases for elevation of the design with the seam.

Third it takes as much time as the former method to make a reversible patchwork quilt because it takes time to cut and stitch up a foundation cloth and an upper cloth. Therefore, it becomes a high-level craft or art which takes time to complete as a hobby.

DETAILED DESCRIPTION OF THE INVENTION

Originally, a patchwork is made by piecing or stitching up two or more cuttings shaped into a triangle, a tetragon, a rhombus, an indeterminate form etc.

It is an age-old technique to make a patchwork by simply piecing some cuttings together. On the other hand, recently, the technique tends to be considered an art, given the various images by changing the way to dispose or piece each of the cuttings, because there are various kinds of colors and patterns of clothes.

Therefore, diversification of designs of a unit of motif has been required.

In the case of an ordinary patchwork quilt, only the surface consists of a combination of some cuttings, with a wide reverse cloth, and a domett core enclosed between them. They are stitched together so as to be decorated with a pattern from the seam.

In contrast with this, in the case of the reversible patchwork quilt according to the present invention, many sets of units of motif are made and connected to each other, and each unit of motif has a foundation cloth 1 and an upper cloth 2 whereby the foundation cloth 1 as the reverse side also has a pattern. A well-designed patchwork quilt is made which has different patterns in the surface and the reverse is made.

In the conventional technique of making a reversible patchwork quilt constructed by stitching up units of motif, each of a foundation cloth and an upper cloth consist of one cutting. However, in the present invention, a foundation cloth 1 and cloth 2 consist of cuttings including different cuttings stitched thereto.

Figure 1:
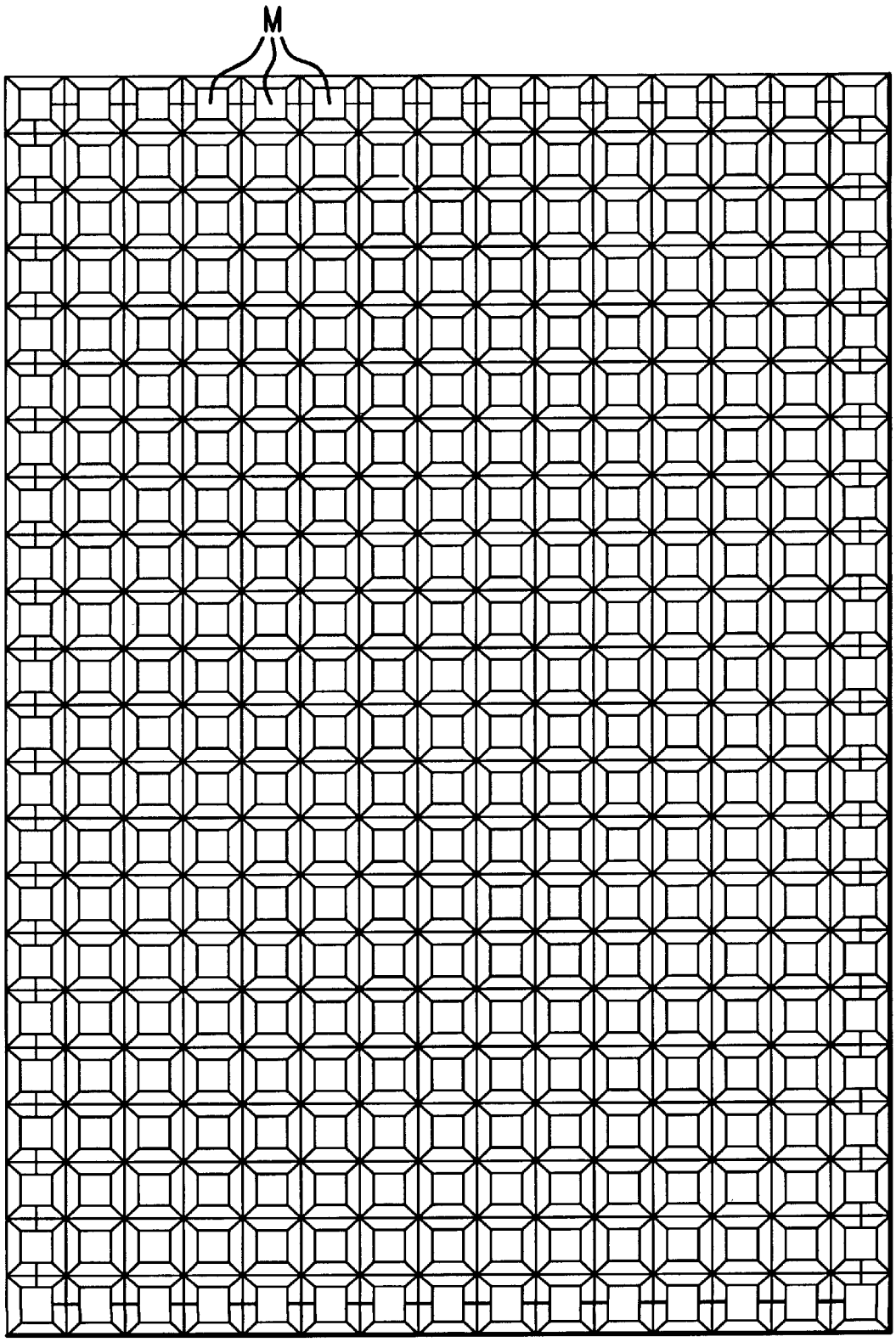
FIG. 1 is a view of the surface of a reversible patchwork quilt.

In FIG. 1 is shown, the surface of a reversible patchwork quilt completed by stitching up 308 units of motif M together. Also the pattern of foundation cloth 1 appears on the reverse side so that the reverse side can also be used.

Figure 2:
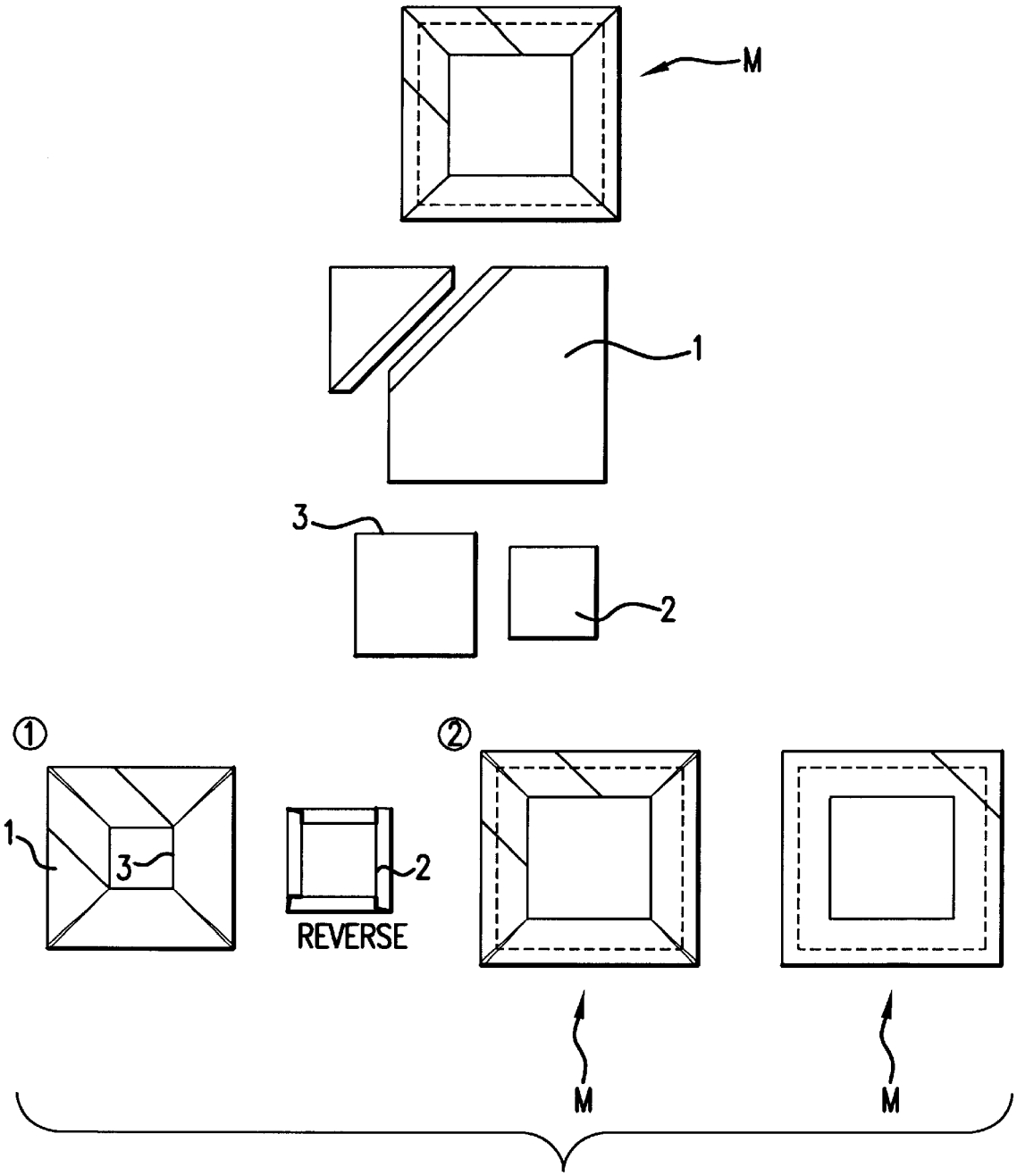
FIG. 2 is a view showing an embodiment wherein a foundation cloth 1 of a unit of motif whose outward shape is a tetragon consists of two different patterned cuttings.

In FIG. 2 is shown an embodiment wherein a foundation cloth 1 is a square and an upper cloth 2 is also a square so that the completed unit of motif is square. The foundation cloth 1 is cut off at one of its edge parts which is replaced by a different patterned cutting. Four sides of the foundation cloth 1 are folded up to its surface, a domett core 3 is enclosed therein, the upper cloth 2 is put on the domett core 3, and they are stitched together in a visible, decorative seam so as to construct a unit of motif M.

Thus, by a different patterned cutting of the edge of the foundation cloth 1, a triangular shaped different patterned part appears in the edge of the reverse of the unit and a herringbone pattern appears in the edge of the surface thereof.

Figure 3:
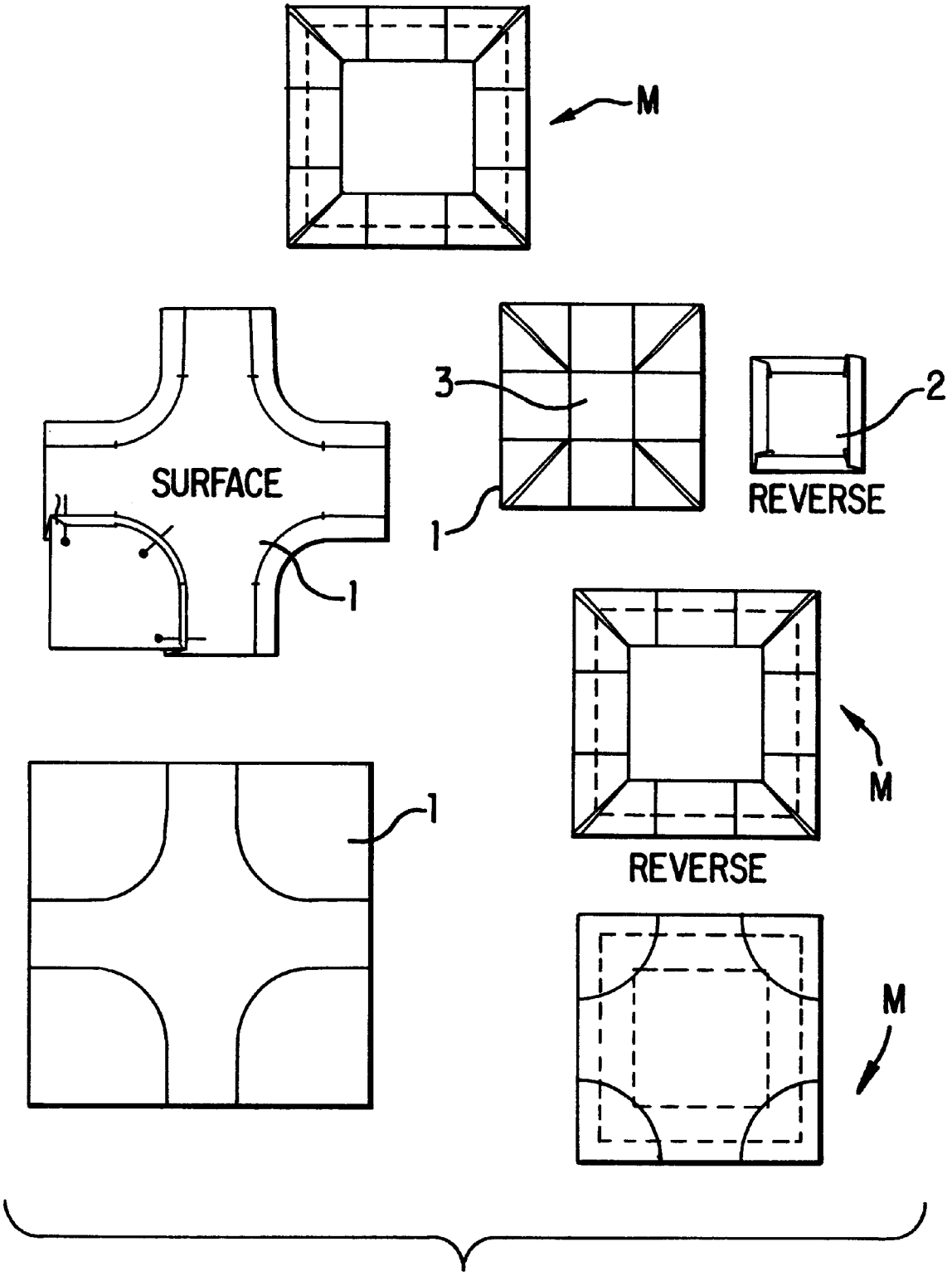
FIG. 3 is a view showing an embodiment wherein a foundation cloth 1 of a unit of motif whose outward shape is a tetragon consists of five pieced cuttings.

In FIG. 3, the four corners of foundation cloth 1 are each cut in a semi-circular pattern and four different patterned cuttings are used to replace the four corners. A domett core 3 and an upper cloth 2 are put on this foundation cloth 1 and stitched together in patterns a seam, whereby quarter circular patterns appear in the four corners of the reverse and double hook-shaped patterns appear in the four corners of the surface.

Figure 4:
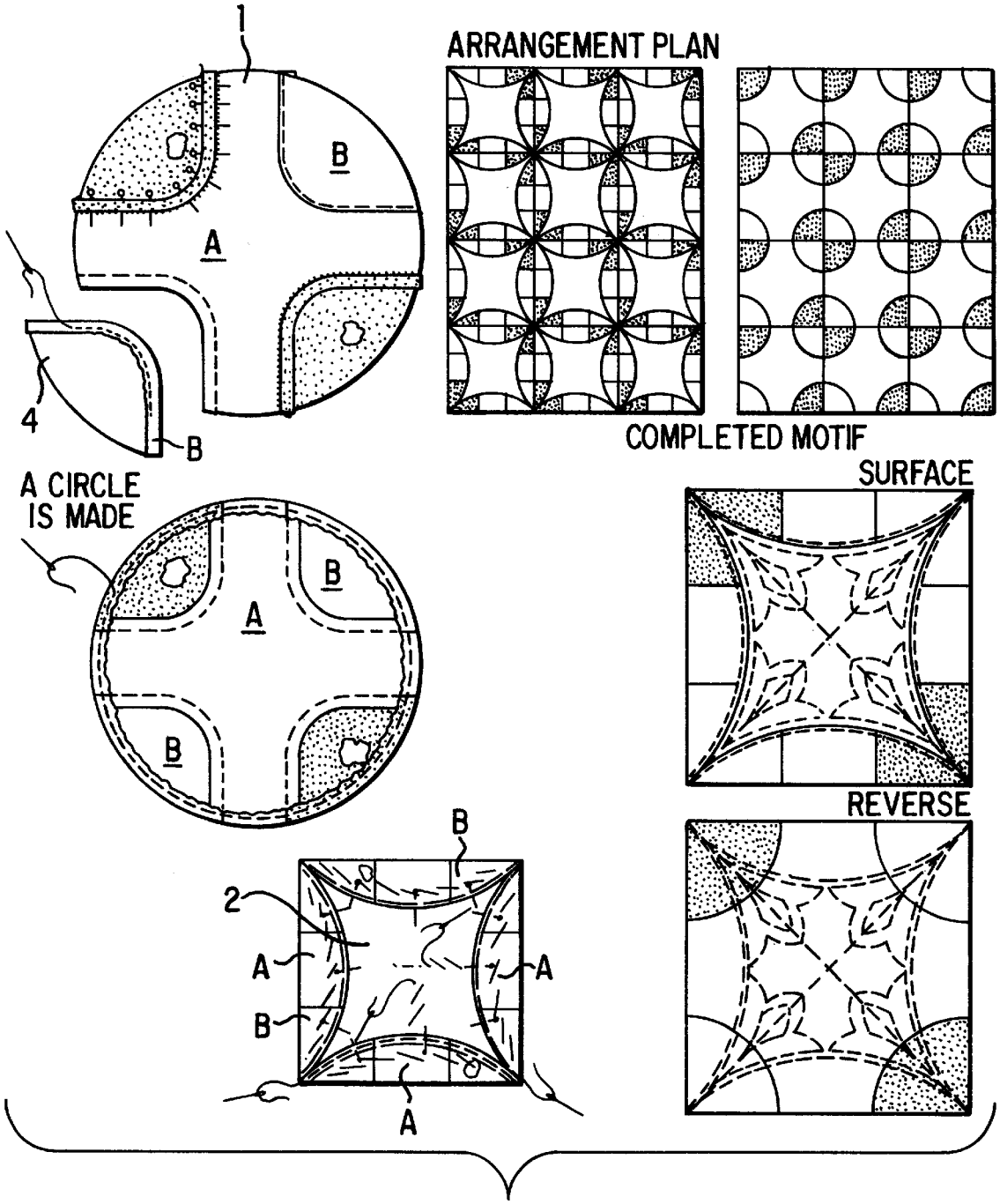
FIG. 4 is a view showing an embodiment wherein a unit of motif whose outward shape is a tetragon consists of a circular foundation cloth 1, which consists of five different patterned cuttings pieced together.

In FIG. 4, a foundation cloth 1 is a circle which is constructed by stitching together a cutting A, which has a circular cut part at each of equal quarter parts divided along its periphery, and different patterned cuttings B. The cutting B is stitched at one of its edges by a wavy seam and is provided with a paper pattern put thereon so as to be folded onto the paper pattern and gathered up. The periphery of this pieced-up circular foundation cloth 1 is stitched by a wavy seam and is provided with a paper pattern for folding up (not shown ) put thereon so as to be gathered up. Afterward, the paper pattern is removed. An upper cloth 2 is a tetragonal and the foundation cloth 1 is folded up to the surface of the upper cloth 2 and is tacked with marking pins. A paper pattern for stitching (not shown ) on which diagonals are drawn is put on the surface of the upper cloth 2 and is traced on it. The space between cloths 1 and 2 is filled with tacking, and then the traced pattern is stitched. Four arcs and the stitching pattern appear on the surface of the upper cloth 2 and some parts of the different patterned cuttings appear on the corners. On the reverse, quarter arcs and stitching patterns appear at the four corners thereof.

Figure 5:
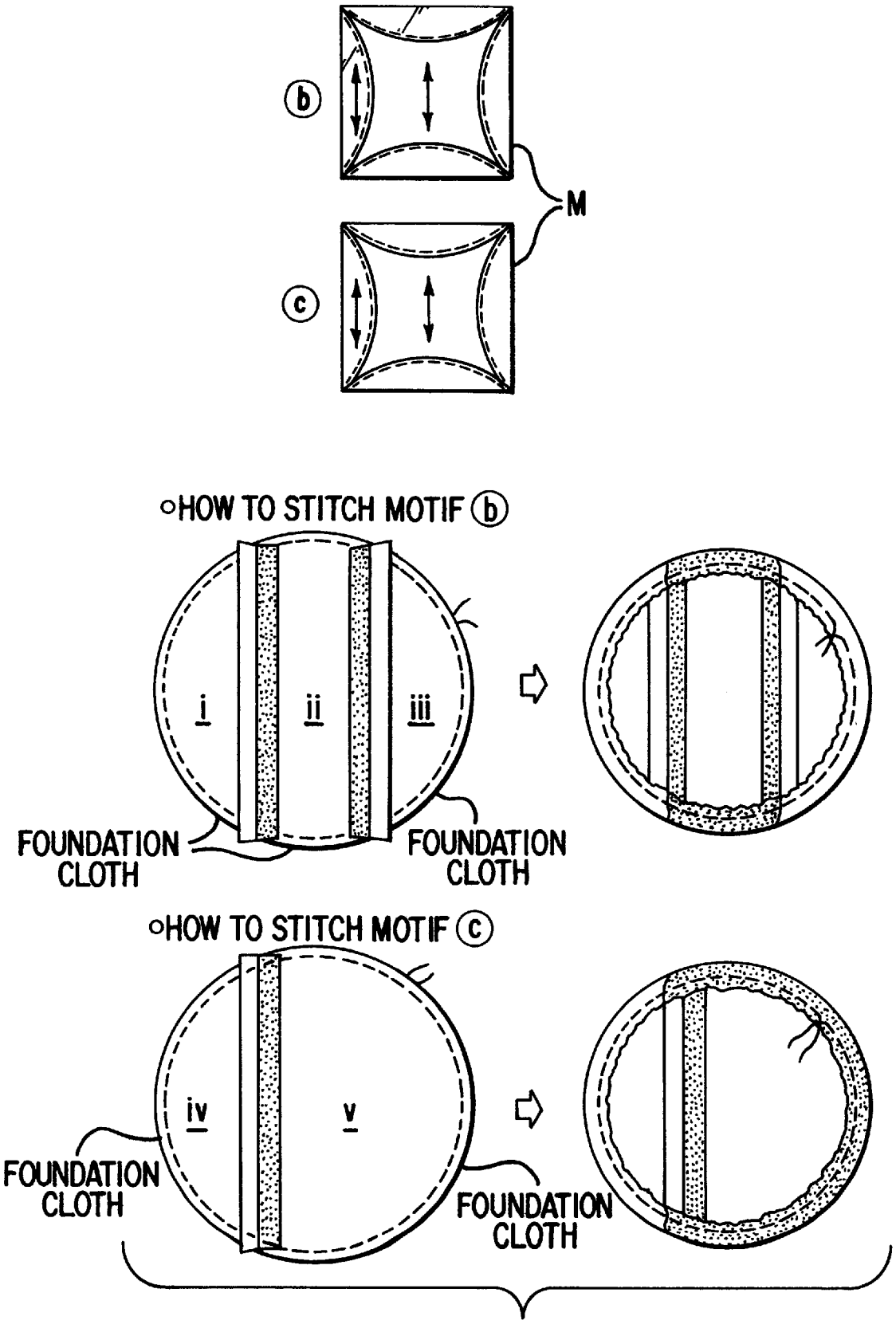
FIG. 5 is a view showing an embodiment wherein a unit of motif consists of a similar circular foundation cloth 1, which is cut up lengthwise into three cuttings and consists of three different patterned cuttings pieced together.

In FIG. 5, a circular foundation cloth 1 is divided into three or two parts lengthwise and differently patterned parts of foundation cloth i, ii iii, iv and v are stitched together to construct a foundation cloth 1. The periphery thereof is stitched up by a wavy seam and is provided with a paper pattern for folding up (not shown ) put thereon so that the margin of the foundation cloth 1 is folded and sewn up. By such a construction, four different colored arcs appear on the surface of a tetragonal unit motif M. On the reverse, a cut lengthwise pattern appears.

Figure 6:
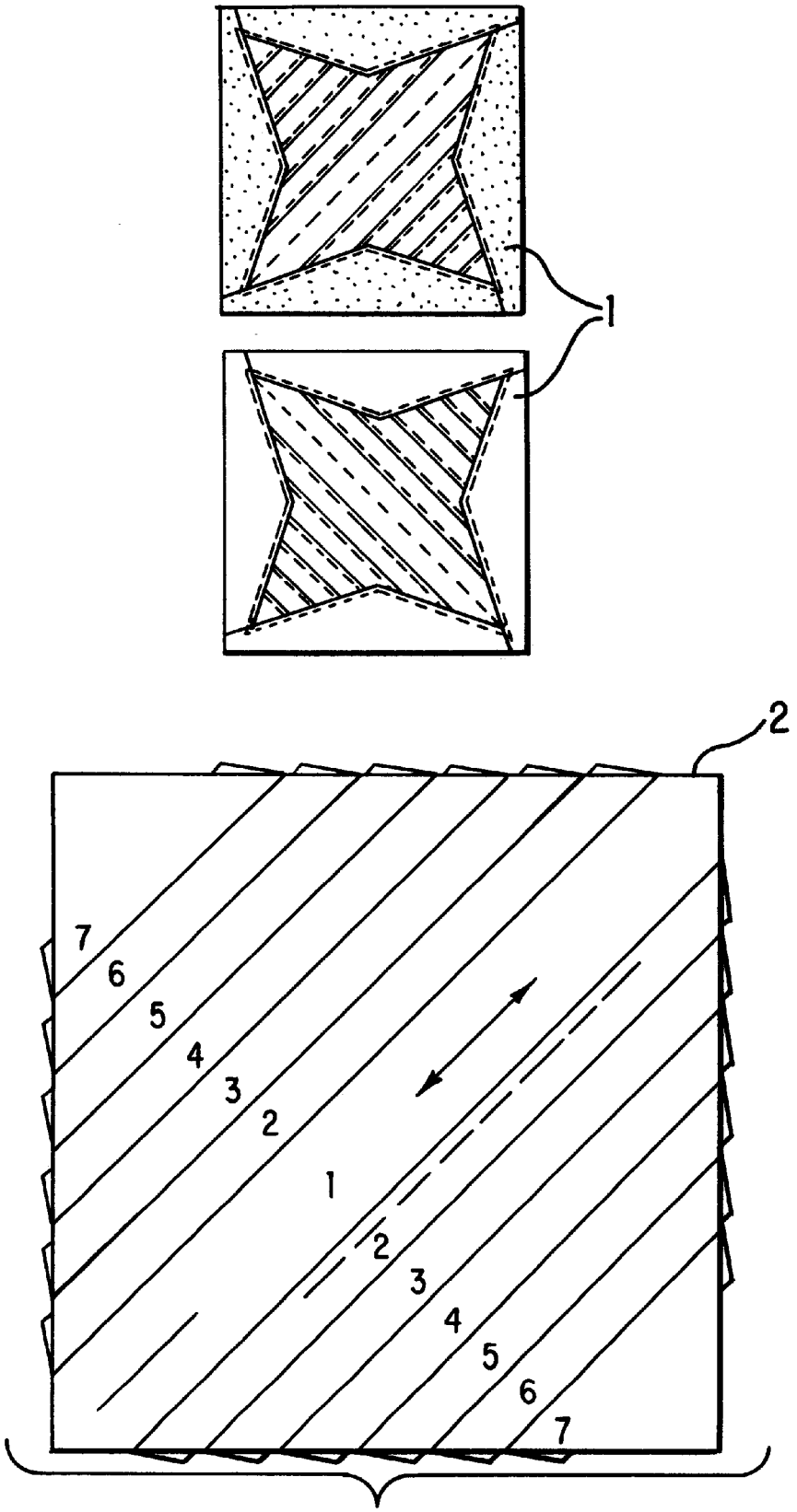
FIG. 6 is a view showing an the embodiment wherein a unit of motif consists of an upper cloth 2 consisting of seventeen diagonally divided different patterned cuttings pieced together and a tetragonal foundation cloth 1.

In FIG. 6, a foundation cloth 1 is tetragonal and an upper cloth 2 is also tetragonal. The tetragonal of the foundation cloth 1 and the upper cloth 2 differ in size, whereby their apexes are moved by 45: The foundation cloth 1 is folded so that the apexes of foundation cloth 1 are disposed at the middle between the apexes of upper cloth 2. The upper cloth 2 is divided into 14 parts diagonally so as to stitch up different patterned cuttings together.

In this way, it is possible that an upper cloth 2 is cut into small strips and different patterned strips are stitched up together so as to construct an upper cloth 2.

Figure 7:
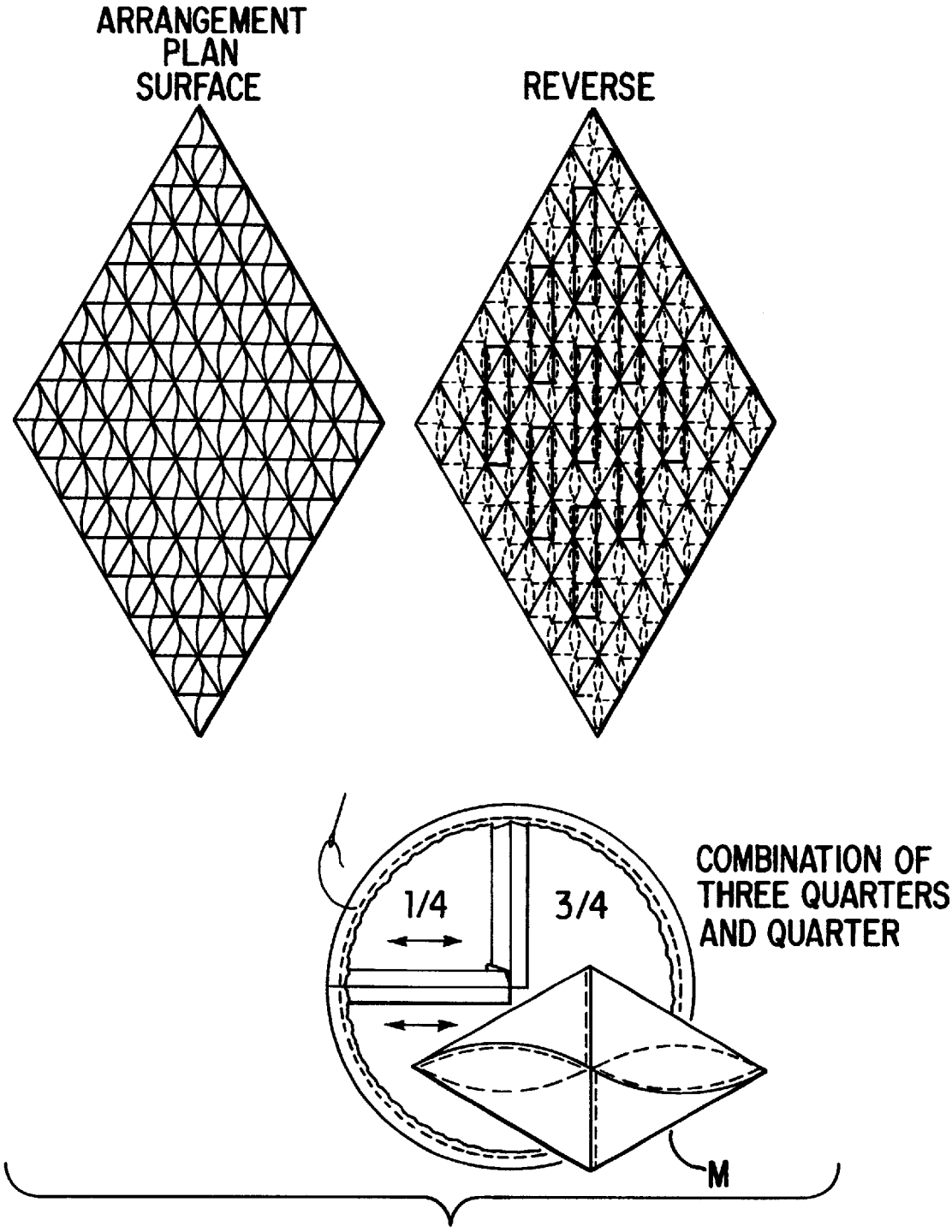
FIG. 7 is a view showing an embodiment wherein a rhombic unit of motif consists of a circular foundation cloth 1, in which a quarter there of is a different patterned cutting, and a domett core without an upper cloth 2.

In FIG. 7, a rhombic unit of motif M consists of a circular foundation cloth 1 which is largely folded to the surface and stitched up into an embroidered pattern directly without using an upper cloth 2. A domett core 3 is enclosed in the foundation cloth 1.

In the embodiment of FIG. 7, a quarter of a circular foundation cloth 1 includes a different patterned cutting stitched thereto.

In this way, as mentioned above, unique patterns can appear on the surface and the reverse.

Figure 8:
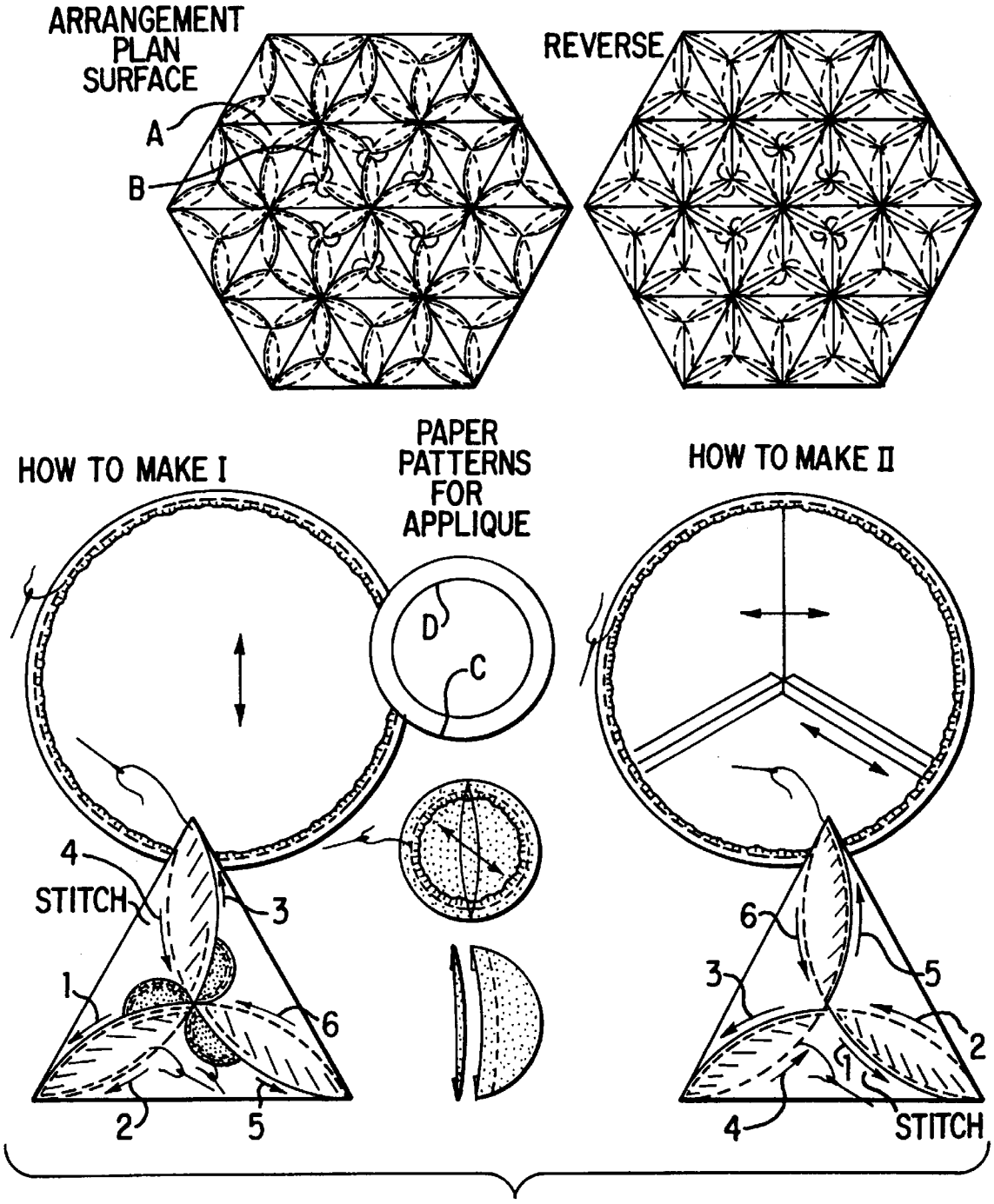
FIG. 8 is a view showing an embodiment wherein a triangle unit of motif consists of a circular foundation cloth 1, which consists of different patterned cuttings, and a domett core without an upper cloth 2.

In FIG. 8, a triangle unit of motif M consists of only a circular foundation cloth 1 without using an upper cloth 2. In this case, a domett core 3 is also enclosed in the foundation cloth 1. This embodiment consists of a circular foundation cloth 1 and one-third or two-thirds includes a different patterned cutting stitched thereto.

A small circular paper pattern for cutting C and a smaller circular paper pattern for folding D for applique are provided for placing onto an upper cloth 2 for applique. The upper cloth 2 is made with the periphery thereof stitched by a wavy seam and gathered along the paper. It is cut into three parts and stitched to the center of the surface of the foundation cloth 1 so as to construct a complex image. Two kinds of triangle units of motif M, I and II are stitched together, as shown in of FIG. 8, whereby a reversible patchwork quilt having a good-design pattern on the surface and the reverse can be made.

Figure 9:
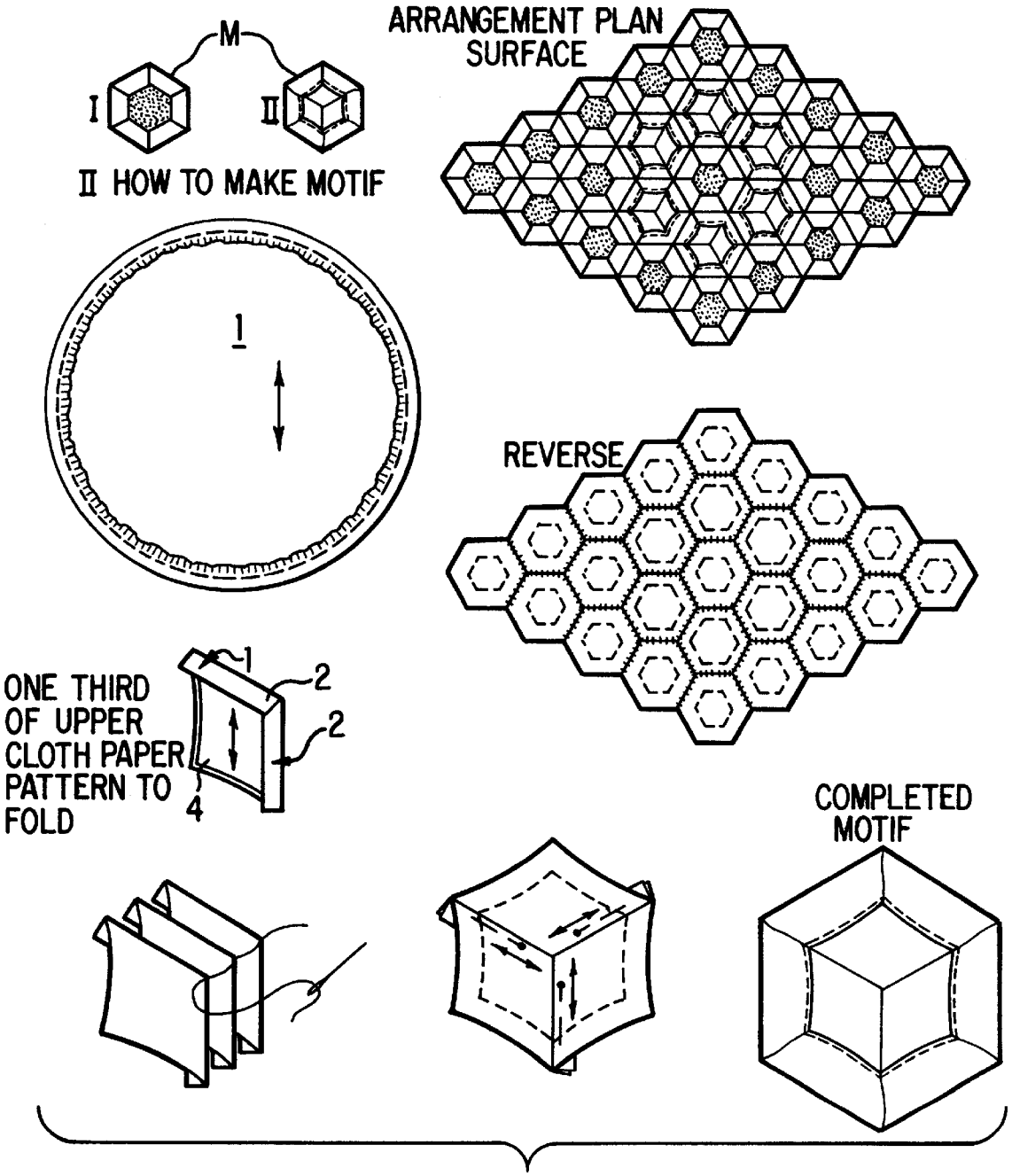
FIG. 9 is a view showing an embodiment wherein a hexagonal unit of motif consists of a circular foundation cloth 1 and a hexagonal upper cloth 2, which consists of three different patterned cuttings.

In FIG. 9, two kinds of motif are shown as I and II. Each hexagonal unit of motif M consists of a circular foundation cloth 1 and a hexagonal upper cloth 2. The periphery of foundation cloth 1 is stitched by a wavy seam and gathered. The upper cloth 2 is cut into three parts and is provided with a paper pattern 4 put on each of the three parts, one at a time, and folded with an iron. As shown in the lower part of FIG. 9, the tops of the creases of three different patterned cuttings are strung together and the end of a thread is knotted on the reverse thereof. Then, the three cuttings are stitched together and the margins thereof are folded down to one side with an iron, so as to construct a unit of motif M. These hexagonal units of motif M are stitched together so that a reversible patchwork quilt has different patterns in the surface and the reverse thereof as shown in FIG. 9.

Figure 10:
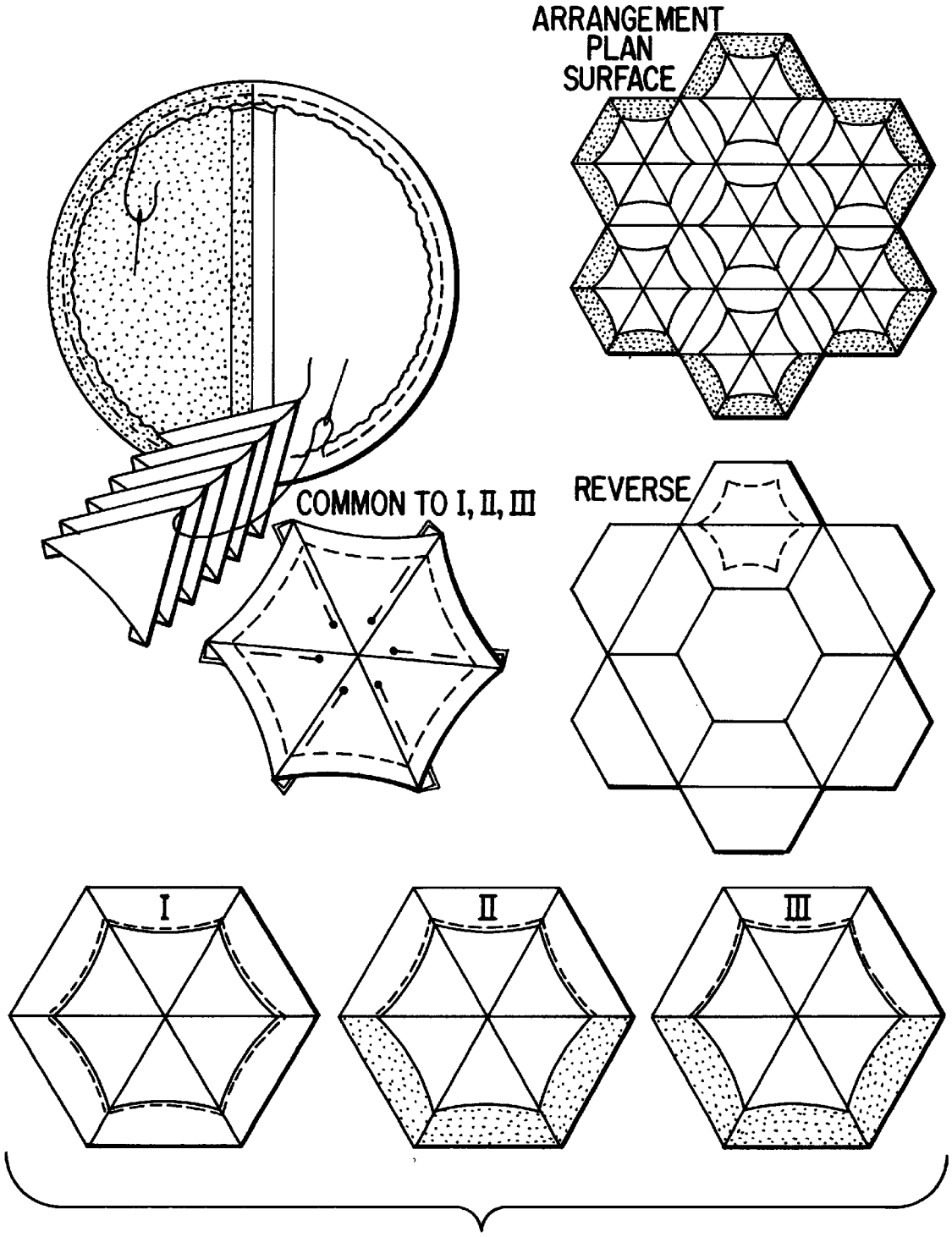
FIG. 10 is a view showing an embodiment wherein a hexagonal unit of motif consists of a circular foundation cloth 1 and an upper cloth 2 and both of which consist of different patterned cuttings pieced together.

In FIG. 10, two types of circular foundation cloths 1, one consisting of a piece of cloth and the other consisting of two different patterned cuttings, are provided and their peripheries are stitched by a wavy seam and gathered. A hexagonal upper cloth 2 is also divided into six cuttings so as to consist of six different patterned cuttings stitched together.

Therefore, three kinds of units of motif M, I, II, and III are made, so that unique patterns can appear on the surface and the reverse thereof as shown in FIG. 10.

Figure 11:
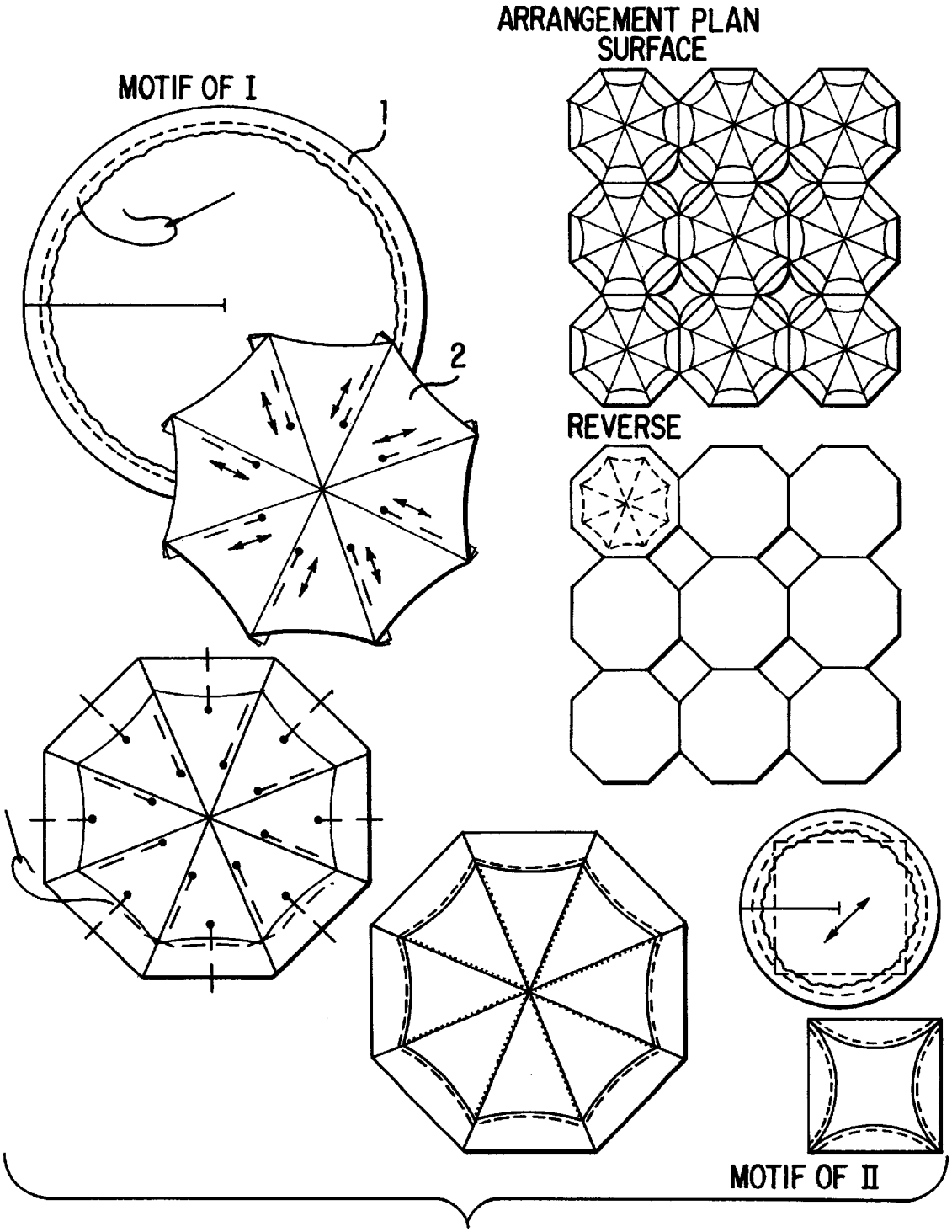
FIG. 11 is a view showing an embodiment wherein an octagonal unit of motif consists of a circular foundation cloth 1 and an upper cloth 2, which consists of eight different patterned cuttings.

In FIG. 11, an octagonal unit of motif M consists of a circular foundation cloth 1 and an octagonal upper cloth 2. The periphery of the foundation cloth 1 is stitched by a wavy seam and gathered. The octagonal upper cloth 2, which is divided into eight cuttings so as to consist of eight different patterned cuttings stitched together, is put onto the foundation cloth 1 and tacked and stitched to the foundation cloth on the periphery and the diagonals thereof.

Therefore, unique patterns can appear on the surface and the reverse of the octagonal unit of motif M as shown in FIG. 11.

According to the present invention, a foundation cloth 1, an upper cloth 2 or both, which compose a unit of motif M, consist of some different patterned cuttings stitched together, whereby various image units of motif M can be created.

What is claimed is:

1. A reversible patchwork quilt having a surface side and a reverse side comprising:

at least two units of a motif having edges stitched together side by side;

each of said at least two units of motif including (a) a foundation cloth, a first portion of which forms a portion of the reverse side of the quilt and a second portion of which forms a portion of the surface side of the quilt, the foundation cloth being at least two different cloths stitched together; (b) an upper cloth forming a portion of the surface of the quilt, the upper cloth being dimensioned such that a portion of the second portion of the foundation cloth remains exposed when the upper cloth is placed thereon; and (c) a core juxtaposed between the foundation cloth and the upper cloth;

each of said at least two units of motif being formed by (1) placing a bottom surface of the core on the foundation cloth; (2) folding the second portion of the foundation cloth over a top surface of the core; (3) placing the upper cloth on the top surface of the core and on a portion of the second portion of the foundation cloth; and (4) stitching the upper cloth to the foundation cloth, whereby the second portion of the foundation cloth is exposed on the surface of the quilt the core is juxtaposed between the foundation cloth and the upper cloth.

2. The reversible patchwork quilt of claim 1, wherein each unit of motif is tetragonal.

3. The reversible patchwork quilt of claim 1, wherein each unit of motif is a triangle.

4. The reversible patchwork quilt of claim 1, wherein each unit of motif is polygonal.

5. The reversible patchwork quilt of claim 1, wherein the upper cloth is at least two different cloths stitched together.

6. The reversible patchwork quilt of claim 1, wherein the foundation cloth is two different cloths stitched together to form a square, one of the two different cloths defines a triangle at the corner of the square, and another of the two different cloths defines a remainder of the square; and the upper cloth is square.

7. The reversible patchwork quilt of claim 1, wherein one of the at least two different cloths of the foundation cloth is formed by cutting a quarter-circle out of each of the four corners of a square-shaped cloth to provide a cross-shaped cloth; the foundation cloth being made by replacing each of the quarter-circles, which were cut out of each of the four corners, by a cloth different from the cross-shaped cloth.

8. The reversible patchwork quilt of claim 1, wherein one of the at least two different cloths of the foundation cloth is formed by cutting a quarter-circle out of each of the four corners of a circular-shaped cloth to provide a cross-shaped cloth; the foundation cloth being made by replacing each of the quarter-circles, which were cut out of each of the four corners, by a cloth different from the cross-shaped cloth.

9. The reversible patchwork quilt of claim 1, wherein the foundation cloth is two different cloths stitched together to form a circle.

10. The reversible patchwork quilt of claim 1, wherein the foundation cloth is three different cloths stitched together to form a circle.

11. A reversible patchwork quilt having a surface side and a reverse side comprising:

at least two units of a motif having edges stitched together side by side;

each of said at least two units of motif comprising (a) a tetragonal foundation cloth, a first portion of which forms the reverse side of the quilt and a second portion of which forms a portion of the surface of the quilt; (b) a tetragonal upper cloth forming a portion of the surface of the quilt, the upper cloth being dimensioned such that a portion of the second portion of the foundation cloth remains exposed when the upper cloth is placed thereon, the upper cloth being formed from at least seven different cloths stitched together, the foundation cloth and the upper cloth differing in size such that the respective apexes of each are shifted 45°; and (c) a core juxtaposed between the foundation cloth and the upper cloth;

each of said at least two units of motif being formed by (1) placing a bottom surface of the core on the foundation cloth; (2) folding the second portion of the foundation cloth over a top surface of the core; (3) placing the upper cloth on the top surface of the core and a portion of the second portion of the foundation cloth; and (4) stitching the upper cloth to the foundation cloth, whereby the second portion of the foundation cloth is exposed on the surface of the quilt and the core is juxtaposed between the foundation cloth and the upper cloth.

12. A reversible patchwork quilt having a surface side and a reverse side comprising:

at least two units of a motif having edges stitched together side by side;

each of said at least two units of motif comprising (a) a foundation cloth, a first portion of which forms a portion of the reverse side of the quilt and a second portion of which forms a portion of the surface of the quilt, the foundation cloth being at least two different cloths stitched together; and (b) a core juxtaposed between the first portion and the second portion of the foundation cloth;

each of said at least two units of motif being formed by (1) placing a bottom surface of the core on the foundation cloth; (2) folding the second portion of the foundation cloth over a top surface of the core; and (3) stitching the first portion of the foundation cloth to the second portion of the foundation cloth, whereby the second portion of the foundation cloth is exposed on the surface of the quilt and the core is juxtaposed between first portion and the second portion of the foundation cloth.

13. The reversible patchwork quilt of claim 12, wherein the foundation cloth is two different cloths stitched together to form a circle, one of the two different cloths defines a quarter of the circle, and another of the two different cloths defines three quarters of the circle.

14. The reversible patchwork quilt of claim 12, wherein the foundation cloth is two different cloths stitched together to form a circle, one of the two different cloths defines a third of the circle, and another of the two different cloths defines two thirds of the circle.

15. A reversible patchwork quilt comprising a surface side and a reverse side of at least two units of a motif stitched together side by side;

each of said at least two units of motif comprising (a) a foundation cloth, a first portion of which forms a portion of the reverse side of the quilt and a second portion of which forms a portion of the surface of the quilt; (b) an upper cloth, which forms a portion of the surface of the quilt, the upper cloth being dimensioned such that a portion of the second portion of the foundation cloth remains exposed when the upper cloth is placed thereon, the upper cloth being formed from at least three different cloths stitched together; and (c) a core juxtaposed between the foundation cloth and the upper cloth;

each of said at least two units of motif being formed by (1) placing a bottom surface of the core on the foundation cloth; (2) folding the second portion of the foundation cloth over a top surface of the core; (3) placing the upper cloth on the top surface of the core and a portion of the second portion of the foundation cloth; and (4) stitching the upper cloth to the foundation cloth, whereby the second portion of the foundation cloth is exposed on the surface of the quilt and the core is juxtaposed between the foundation cloth and the upper cloth.

16. The reversible patchwork quilt of claim 15, wherein the foundation cloth is a circle and the upper cloth is a hexagon.

17. The reversible patchwork quilt of claim 15, wherein the foundation cloth is a circle formed from at least two different cloths stitched together and the upper cloth is formed from at least six different cloths stitched together.

18. The reversible patchwork quilt of claim 15, wherein the foundation cloth is a circle and the upper cloth is formed from at least eight different cloths stitched together.

* * * * *